US012612085B2

(12) United States Patent
Uchida et al.

(10) Patent No.: US 12,612,085 B2
(45) Date of Patent: Apr. 28, 2026

(54) BOGIE AND VEHICLE

(71) Applicant: MITSUBISHI HEAVY INDUSTRIES, LTD., Tokyo (JP)

(72) Inventors: Koji Uchida, Tokyo (JP); Hiroyuki Kono, Tokyo (JP); Masaya Mitake, Tokyo (JP); So Tamura, Kanagawa (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 707 days.

(21) Appl. No.: 17/995,600

(22) PCT Filed: Apr. 13, 2021

(86) PCT No.: PCT/JP2021/015314
§ 371 (c)(1),
(2) Date: Oct. 6, 2022

(87) PCT Pub. No.: WO2021/210578
PCT Pub. Date: Oct. 21, 2021

(65) Prior Publication Data

US 2023/0150554 A1 May 18, 2023

(30) Foreign Application Priority Data

Apr. 14, 2020 (JP) ..... 2020-072515

(51) Int. Cl.
*B61F 3/04* (2006.01)
*B61C 9/50* (2006.01)

(52) U.S. Cl.
CPC . *B61F 3/04* (2013.01); *B61C 9/50* (2013.01)

(58) Field of Classification Search
CPC ... B60K 17/12; B61C 9/50; B61F 3/04; B60L 15/20; H02P 5/46
See application file for complete search history.

(56) References Cited

U.S. PATENT DOCUMENTS 4,867,072 A * 9/1989 Kleim ..... B61D 13/00 105/49
2011/0315044 A1 12/2011 Maeyama et al.
(Continued)

FOREIGN PATENT DOCUMENTS

JP 2000142386 A * 5/2000
JP 2000309268 A 11/2000
(Continued)

OTHER PUBLICATIONS

Singapore Written Opinion for Singapore Application No. 11202253760N dated Sep. 17, 2024; 8 pp.
(Continued)

*Primary Examiner* — Jason C Smith
(74) *Attorney, Agent, or Firm* — HAUPTMAN HAM, LLP

(57) ABSTRACT

This bogie and vehicle is provided with: a bogie body; a pair of travel wheels disposed on both sides of the bogie body in a direction intersecting with the traveling direction and capable of rolling motion on the traveling road surface of a track; a guide device guided along a guide rail and rotatably supported to the bogie body about the axial line along a vertical direction; and a pair of motors disposed between the pair of travel wheels of the bogie body and transferring a drive force to the pair of travel wheels.

9 Claims, 2 Drawing Sheets

(56) References Cited

U.S. PATENT DOCUMENTS

| | | | | |
|---|---|---|---|---|
| 2016/0272222 | A1 | 9/2016 | Katahira et al. | |
| 2023/0150554 | A1 * | 5/2023 | Uchida | B61C 9/50 105/34.1 |

FOREIGN PATENT DOCUMENTS

| | | | | |
|---|---|---|---|---|
| JP | 2001145207 | A | 5/2001 | |
| JP | 2003025993 | A * | 1/2003 | |
| JP | 4461189 | B2 | 5/2010 | |
| WO | WO-2015075995 | A1 * | 5/2015 | B61B 13/00 |
| WO | WO-2017158956 | A1 * | 9/2017 | B60L 15/20 |

OTHER PUBLICATIONS

International Search Report and Written Opinion of International Application No. PCT/JP2021/015314 mailed Jun. 29, 2021; 13pp.

* cited by examiner

BOGIE AND VEHICLE

RELATED APPLICATIONS

The present application is a National Phase of International Application Number PCT/JP2021/015314 filed Apr. 13, 2021 and claims priority of Japanese Application Number 2020-072515 filed Apr. 14, 2020.

TECHNICAL FIELD

The present disclosure relates to a bogie and a vehicle including a bogie.

BACKGROUND ART

As new transportation means, a railway transportation system that runs on a railway by using a running wheel such as a rubber tire is known. A vehicle used for the railway transportation systems is guided by a guide rail in which guide wheels provided on both sides in a width direction are disposed along the railway.

The vehicle used for the railway transportation system includes a vehicle body and a bogie. The bogie is configured so that a bogie body is equipped with an electric motor, a power transmission mechanism, a differential gear, a constant velocity ball joint for steering, a braking device, and a running wheel. Therefore, when the electric motor is driven, a driving rotational force is decelerated by the power transmission mechanism, is distributed to axles on both sides by the differential gear, and is transmitted to a pair of right and left running wheels via the constant velocity ball joint so that the pair of running wheels is rotationally driven. For example, the bogie configured in this way is disclosed in PTL 1 below.

CITATION LIST

Patent Literature

[PTL 1] Japanese Patent No. 4461189

SUMMARY OF INVENTION

Technical Problem

In the railway vehicle in the related art described above, the driving rotational force of the electric motor disposed in a central portion of the bogie body is distributed and transmitted to the pair of running wheels by the differential gear. Therefore, a space in the central portion of the bogie body is occupied by the electric motor, thereby causing a problem in that the bogie body is less likely to be equipped with other devices.

The present disclosure is to solve the above-described problem, and an object of the present disclosure is to provide a bogie and a vehicle which can achieve a compact device and can effectively use a space.

Solution to Problem

According to the present disclosure, in order to achieve the above-described object, there is provided a bogie including a bogie body, a pair of running wheels disposed on both sides of the bogie body in a direction intersecting with a running direction of the bogie body and rollable on a running road surface of a railway, a guide device guided along a guide rail and supported to be pivotable around an axial center along a vertical direction by the bogie body, and a pair of motors disposed between the pair of running wheels in the bogie body and transmitting a drive force to the pair of running wheels.

In addition, according to the present disclosure, there is provided a vehicle including the bogie and a vehicle body supported from below by the bogie.

Advantageous Effects of Invention

According to the bogie of the present disclosure, a compact device can be achieved, and a space can be effectively used.

DESCRIPTION OF EMBODIMENTS

Hereinafter, a preferred embodiment of the present disclosure will be described in detail with reference to the drawings. The present disclosure is not limited by the embodiment. In a case where there are a plurality of the embodiments, the present disclosure also includes a configuration adopted by combining the respective embodiments with each other. In addition, configuration elements in the embodiment include those which can be easily assumed by those skilled in the art, those which are substantially the same, and those which have a so-called equivalent scope.

[Configuration of Vehicle]

Figure 1:
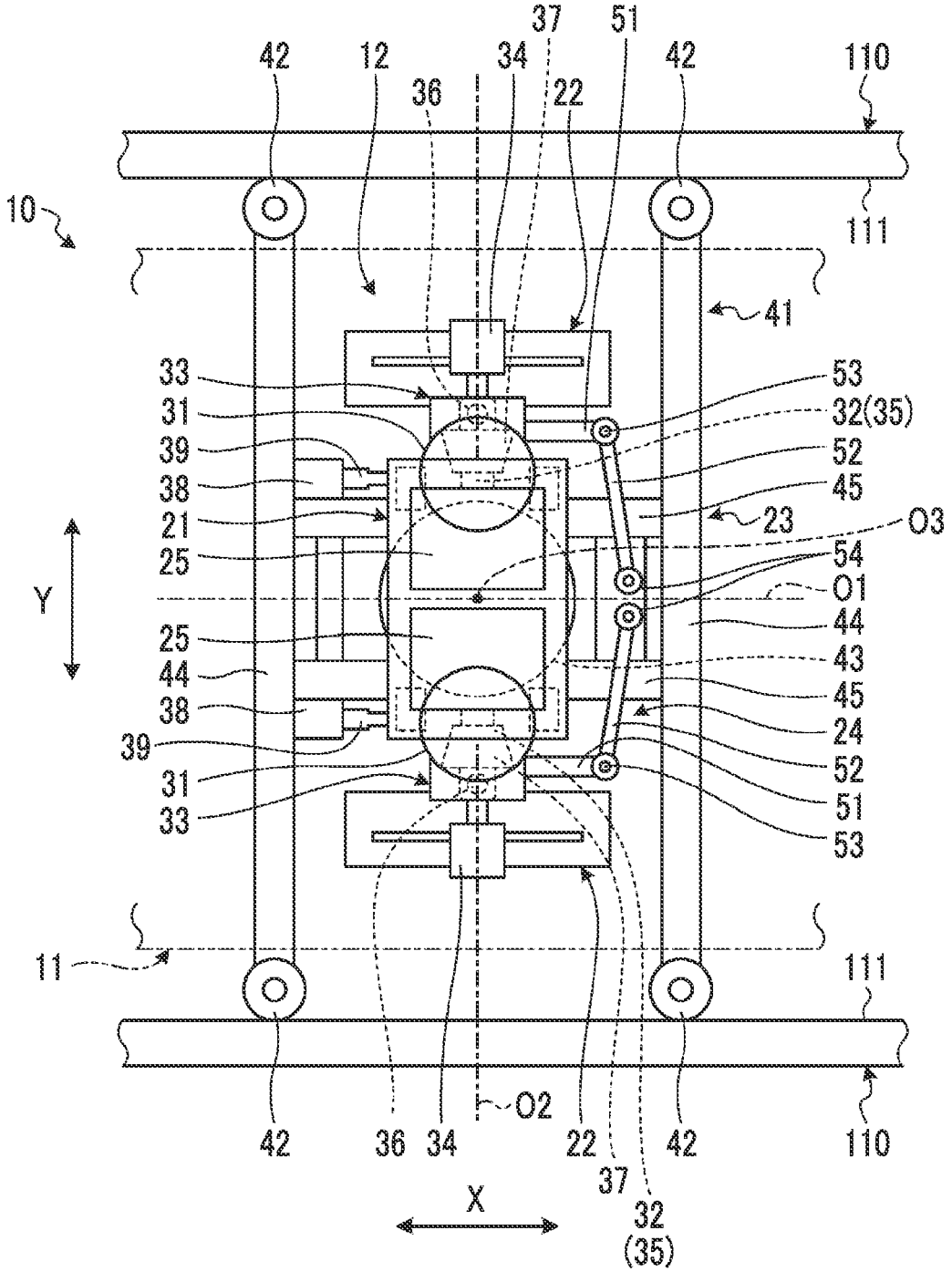
FIG. 1 is a schematic plan view illustrating a vehicle including a bogie of the present embodiment.
Figure 2:
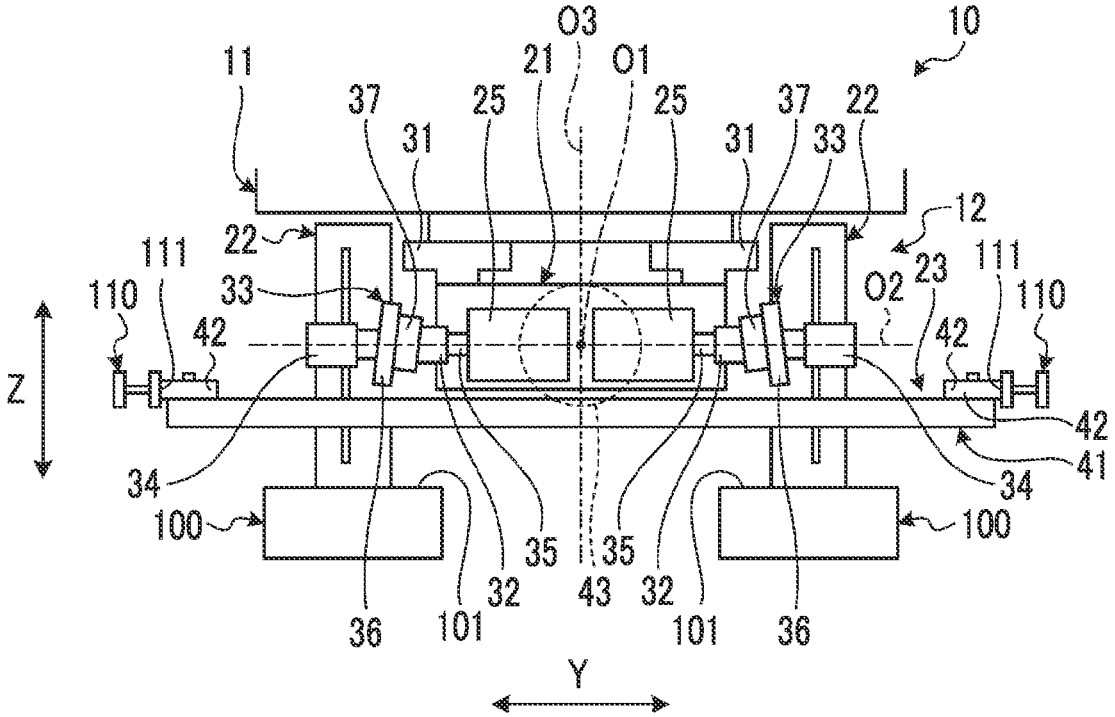
FIG. 2 is a front view of the vehicle.
Figure 3:
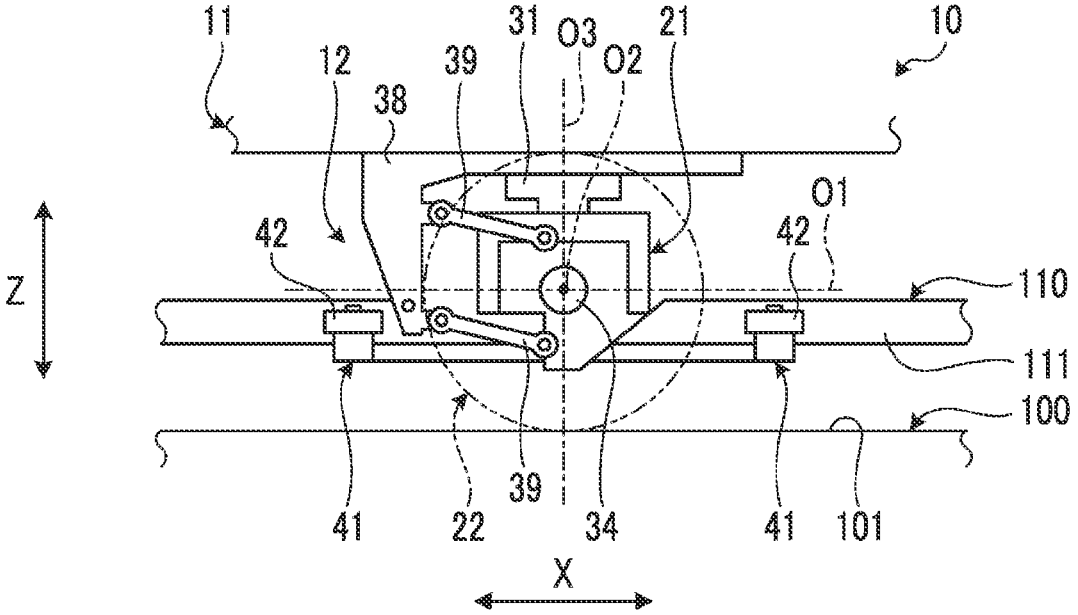
FIG. 3 is a side view of the vehicle.

FIG. 1 is a schematic plan view illustrating a vehicle including a bogie of the present embodiment, FIG. 2 is a front view of the vehicle, and FIG. 3 is a side view of the vehicle. In the following description, a running (forward-rearward) direction of the vehicle will be defined as an X-direction, a rightward-leftward (width) direction intersecting with the running direction (X-direction) of the vehicle will be defined as a Y-direction, and a vertical (height) direction intersecting with the running direction (X-direction) and the rightward-leftward direction (Y-direction) of the vehicle will be defined as a Z-direction. In addition, a center along the X-direction of the vehicle will be defined as an axial center O1, a center along the Y-direction of the vehicle will be defined as an axial center O2, and a center along the Z-direction of the vehicle will be defined as an axial center O3. The axial center O2 is a rotation center of the running wheel, the axial center O1 is orthogonal to the axial center O2 in a horizontal direction at an intermediate position in the width direction of the vehicle, and the axial center O3 is orthogonal to the axial center O1 and the axial center O2 in the vertical direction at the intermediate position in the width direction of the vehicle.

In the present embodiment, as illustrated in FIGS. 1 to 3, a vehicle 10 is a vehicle of a new transportation system which runs on a running road surface 101 of a railway 100 and is guided by a guide surface 111 of guide rails 110 provided on both sides of the railway 100. The vehicle 10 is applied to a new side guide rail type (side guide type) transportation system in which the railway 100 is disposed below and the guide rail 110 is disposed outside the railway 100 in the Y-direction.

The vehicle 10 includes a vehicle body 11 and a bogie 12. For example, the vehicle body 11 carries an occupant or a passenger. The bogie 12 causes the vehicle body 11 to run along the railway 100 and the guide rail 110. The bogie 12 is provided in each of a front lower portion and a rear lower portion of the vehicle body 11. In addition, FIGS. 1 to 3 illustrate only one bogie 12.

The bogie 12 includes a bogie body 21, a pair of running wheels 22, a guide device 23, a steering device 24, and a pair of motors 25.

The bogie body 21 is disposed at an intermediate position in the Y-direction of the vehicle body 11. The bogie body 21 has a frame shape, and a pair of right and left bolster springs 31 is disposed in an upper portion, and a lower portion of the vehicle body 11 is supported by the bolster spring 31.

The pair of running wheels 22 is disposed on both right and left sides of the bogie body 21 in the Y-direction. The running wheel 22 is rollable on the running road surface 101 of the railway 100. The bogie body 21 is internally equipped with the pair of motors 25. The pair of motors 25 is disposed between the pair of running wheels 22 in the bogie body 21. The pair of motors 25 can transmit a drive force to the pair of running wheels 22. The pair of running wheels 22 is rotatable around an axial center O2 along the Y-direction.

In the bogie body 21, a spline joint 32, a pair of constant velocity ball joints 33, and a pair of speed reducers 34 are disposed between the pair of running wheels 22 and the pair of motors 25. In the motor 25, an output shaft 35 is connected to the constant velocity ball joint 33 via the spline joint 32. However, the output shaft 35 of the motor 25 may be directly connected to the constant velocity ball joint 33. The constant velocity ball joint 33, a kingpin 36, and an attachment shaft 37 are provided between the output shaft 35 and the speed reducer 34. The running wheel 22 is a rubber tire supported on the bogie body 21 side via the attachment shaft 37, and a metal wheel and a brake disc forming a braking device are mounted inside the running wheel 22. The running wheel 22 is integrated with the attachment shaft 37, and is pivotable around the kingpin 36 serving as a fulcrum in the X-direction. In other words, the running wheel 22 is pivotable around a Z-axis direction.

For example, the speed reducer 34 is a planetary gear mechanism. The speed reducer 34 is a hub reduction disposed inside a wheel forming the running wheel 22. However, the speed reducer 34 may be disposed between the output shaft 35 of the motor 25 and the constant velocity ball joint 33. The pair of motors 25 includes an electric motor, and is disposed on an upper side of the guide device 23 in the Z-direction. A rotation axial center of the pair of motors 25 and a rotation axial center of the pair of running wheels 22 are disposed on a straight line (axial center O2) along the rightward-leftward direction (Y-direction) intersecting with the running direction (X-direction) of the bogie body 21. The output shaft 35 of the motor 25, the spline joint 32, the constant velocity ball joint 33, the speed reducer 34, and the running wheel 22 are disposed on a straight line (axial center O2) along the Y-direction. In this case, the motor 25, the spline joint 32, the constant velocity ball joint 33, the speed reducer 34, and the running wheel 22 are disposed to be line-symmetrical in the Y-direction with respect to the axial center O1.

The pair of running wheels 22 are supported to be rotatable in the bogie body 21. The bogie body 21 is fixed to a lower portion of the vehicle body 11, and is connected to a suspension frame 38 extending downward via a pair of upper and lower traction rods 39.

The guide device 23 has a guide frame 41, a plurality of guide wheels 42, and a turning bearing 43. The guide frame 41 has two horizontal beams 44 and two vertical beams 45. The two horizontal beams 44 are disposed along the Y-direction, and are disposed at a predetermined interval in the X-direction. The two vertical beams 45 are disposed along the X-direction, and are disposed at a predetermined interval in the Y-direction. Each end portion is connected to the two horizontal beams 44. The two horizontal beams 44 are mounted at each end portion in the Y-direction so that the guide wheel 42 is rotatable around the rotation axial center along the Z-direction. Each of the guide wheels 42 can come into contact with the guide surface 111 of the guide rail 110. In addition, the guide frame 41 is supported to be pivotable around the axial center O3 along the vertical direction by the turning bearing 43 in the bogie body 21.

Therefore, when the bogie 12 runs on a curved portion of the railway 100, each of the guide wheels 42 comes into contact with the guide rail 110. In this manner, the guide frame 41 is pivotable along the curved portion by the turning bearing 43. That is, in the vehicle 10, each of the guide wheels 42 receives a reaction force from the outer guide rail 110 of the curved portion, the guide frame 41 pivots so that the outer guide wheel 42 is pushed forward compared to the inner guide wheel 42.

In addition, when the bogie 12 runs on the curved portion of the railway 100, rolling distances of the pair of running wheels 22 are different. Therefore, a torque of each of the motors disposed on both sides is controlled to rotate the motor in accordance with a tire rolling distance. In addition, a rotation speed of the pair of motors 25 is adjusted and controlled in accordance with an operation state of the guide device 23. In this manner, curved running can be smoothly performed. Although not illustrated, the bogie body 21 is provided with a control device that controls the pair of motors 25. The control device adjusts the rotation speed of the pair of motors 25, based on a pivoting angle from a reference position of the guide frame 41 and a pressing force (load) applied to the guide rail 110 by the guide wheel 42.

The steering device 24 is provided on a front side of the running wheel 22 in the running direction of the vehicle 10. The steering device 24 has a pair of right and left steering arms 51 and a pair of right and left steering rods 52. One end portion of the steering arm 51 and the steering rod 52 in a longitudinal direction is connected to be pivotable by a connection pin 53. Then, the other end portion of the steering arm 51 in the longitudinal direction is fixed to the attachment shaft 37, and the other end portion of the steering rod 52 in the longitudinal direction is connected to the guide frame 41 to be pivotable by a connection pin 54.

Therefore, the steering arm 51 horizontally oscillates around the kingpin 36 serving as a fulcrum together with the running wheel 22, and the steering rod 52 oscillates in response to oscillation of the steering arm 51. When the guide frame 41 pivots around the axial center O3, a pivoting operation of the guide frame 41 is transmitted to the steering arm 51 via the steering rod 52, and the attachment shaft 37 pivots around the kingpin 36 serving as the fulcrum so that the running wheel 22 is steered.

[Operation of Vehicle]

When the pair of motors 25 is driven, the driving rotational force is transmitted to the speed reducer 34 via the spline joint 32 and the constant velocity ball joint 33. The speed reducer 34 decelerates the transmitted driving rotational force, and transmits the driving rotational force to the running wheels 22 so that the running wheels 22 are rotationally driven. In the vehicle 10, since the running wheel 22 is rotationally driven, the running wheel 22 rolls on the running road surface 101 of the railway 100. In this case, each of the guide wheels 42 of the guide device 23 is guided to the guide surface 111 of the guide rail 110 so that the vehicle 10 can run along the railway 100.

When the vehicle 10 reaches the curved portion of the railway 100, each of the guide wheels 42 receives the reaction force from the outer guide rail 110 of the curved portion, and the guide frame 41 pivots so that the outer guide wheel 42 is pushed forward in the running direction, compared to the inner guide wheel 42. In this case, the steering rod 52 and the steering arm 51 oscillate in response to pivoting of the guide frame 41, and the attachment shaft 37 pivots around the kingpin 36 serving as the fulcrum so that the running wheel 22 is steered. Therefore, the vehicle 10 can run along the railway 100 even when the vehicle 10 reaches the curved portion of the railway 100.

Operational Effect of Present Embodiment

The bogie according to a first aspect includes the bogie body 21, the pair of running wheels 22 disposed on both sides of the bogie body 21 in the rightward-leftward direction intersecting with the running direction of the bogie body 21 and rollable on the running road surface 101 of the railway 100, the guide device 23 guided along the guide rail 110 and supported to be pivotable around the axial center along the vertical direction by the bogie body 21, and the pair of motors 25 disposed between the pair of running wheels 22 in the bogie body 21 and transmitting the drive force to the pair of running wheels 22.

In the bogie according to the first aspect, the pair of motors 25 that transmit the drive force to the pair of running wheels 22 is disposed between the pair of running wheels 22 in the bogie body 21. Therefore, the pair of motors 25 can be efficiently disposed in the bogie body 21. Accordingly, a compact device can be achieved, and a space in the bogie body 21 can be effectively used.

In the bogie according to a second aspect, the pair of speed reducers 34 is provided between the output shaft 35 of the pair of motors 25 and the rotary shaft of the pair of running wheels 22. In this manner, the speed reducer 34 can be efficiently disposed so that a compact device can be achieved. The rotational drive force of the motor 25 is decelerated by the speed reducer 34, and is transmitted to the running wheels 22. Therefore, a large output torque can be secured.

In the bogie according to a third aspect, the pair of speed reducers 34 is disposed inside the pair of running wheels 22. In this manner, a compact device can be achieved.

In the bogie according to a fourth aspect, the pair of constant velocity ball joints 33 is provided between the output shaft 35 of the pair of motors 25 and the rotary shaft of the pair of running wheels 22. In this manner, the constant velocity ball joint 33 can be efficiently disposed so that a compact device can be achieved, and steerability of the running wheel 22 can be secured.

In the bogie according to a fifth aspect, the pair of spline joints 32 is provided between the output shaft 35 of the pair of motors 25 and the rotary shaft of the pair of running wheels 22. In this manner, the rotational drive force of the motor 25 can be properly transmitted to the running wheel 22 by the spline joint 32.

In the bogie according to a sixth aspect, the rotation axial center of the pair of motors 25 and the rotation axial center of the pair of running wheels 22 are disposed on the straight line along the rightward-leftward direction intersecting with the running direction of the bogie body 21. In this manner, a compact device can be achieved.

In the bogie according to a seventh aspect, the pair of motors 25 is disposed above the guide device 23 in the vertical direction. In this manner, a compact device can be achieved.

In the bogie according to an eighth aspect, the control device that controls the rotation speed of the pair of motors 25 in accordance with the operation state of the guide device 23 is provided. In this manner, running stability of the bogie can be improved in the curved portion of the railway 100.

The vehicle according to a ninth aspect includes the bogie 12 and the vehicle body 11 supported from below by the bogie 12. In this manner, the pair of motors 25 can be efficiently disposed in the bogie 12 so that a compact device can be achieved, and a space in the bogie body 21 can be effectively used.

In the above-described embodiment, the rotation axial center of the pair of motors 25 and the rotation axial center of the pair of running wheels 22 are disposed on the straight line along the Y-direction. However, when necessary, the motor 25 and the running wheel 22 may be disposed to be shifted in the X-direction or the Z-direction.

REFERENCE SIGNS LIST

10: Vehicle
11: Vehicle body
12: Bogie
21: Bogie body
22: Running wheel
23: Guide device
24: Steering device
25: Motor
31: Bolster spring
32: Spline joint
33: Constant velocity ball joint
34: Speed reducer
35: Output shaft
36: Kingpin
37: Attachment shaft
38: Suspension frame
39: Traction rod
41: Guide frame
42: Guide wheel
43: Turning bearing
44: Horizontal beam
45: Vertical beam
51: Steering arm
52: Steering rod
53, 54: Connection pin
100: Railway
101: Running road surface
110: Guide rail
111: Guide surface
O1, O2, O3: Axial center

The invention claimed is:

1. A bogie comprising:

a bogie body;

a pair of running wheels disposed on both sides of the bogie body in a rightward-leftward direction intersecting with a running direction of the bogie body and rollable on a running road surface of a railway;

a guide device guided along a guide rail and supported to be pivotable around an axial center along a vertical direction by the bogie body; and a pair of motors disposed between the pair of running wheels in the bogie body in the rightward-leftward direction and transmitting a drive force to the pair of running wheels, wherein, the pair of running wheels includes a first running wheel; and a second running wheel which is positioned on a rightward of the first running wheel in the rightward-leftward direction, the first running wheel and the second running wheel rotate around an axial center along the rightward-leftward direction, the pair of motors includes; a first motor which is positioned on the rightward of the first running wheel and on a leftward of the second running wheel in the rightward-leftward direction and is configured to transmit the drive force to the first running wheel; and a second motor which is positioned on the rightward of the first motor and on the leftward of the second running wheel and is configured to transmit the drive force to the second running wheel, and a rotational axis of the first motor and second motor passes on a center of the bogie body in the running direction and is disposed on an axis along the rightward-leftward direction.

2. The bogie according to claim 1, wherein a pair of speed reducers is provided between an output shaft of the pair of motors and a rotary shaft of the pair of running wheels.

3. The bogie according to claim 2, wherein the pair of speed reducers is disposed inside the pair of running wheels.

4. The bogie according to claim 1, wherein a pair of constant velocity ball joints is provided between an output shaft of the pair of motors and a rotary shaft of the pair of running wheels.

5. The bogie according to claim 1, wherein a pair of spline joints is provided between an output shaft of the pair of motors and a rotary shaft of the pair of running wheels.

6. The bogie according to claim 1, wherein a rotation axial center of the pair of motors and a rotation axial center of the pair of running wheels are disposed on a straight line along a direction intersecting with the running direction of the bogie body.

7. The bogie according to claim 1, wherein the pair of motors is disposed above the guide device in the vertical direction.

8. The bogie according to claim 1, wherein a control device that controls a rotation speed of the pair of motors in accordance with an operation state of the guide device is provided.

9. A vehicle comprising: the bogie according to any one of claim 1; and a vehicle body supported from below by the bogie.

* * * * *